US005533569A

United States Patent [19]

Reibel et al.

[11] Patent Number: 5,533,569

[45] Date of Patent: Jul. 9, 1996

[54] STATIONARY SYPHON SYSTEM FOR ROTATING HEAT EXCHANGER ROLLS

[75] Inventors: John C. Reibel, Portage, Mich.; Uwe Schindhelm, Neuhaus-Schierschnitz, Germany

[73] Assignees: The Johnson Corporation, Three Rivers, Mich.; Maschinenfabrik Friese GmbH & Co. Kg., Germany

[21] Appl. No.: 426,964

[22] Filed: Apr. 24, 1995

[51] Int. Cl.[6] ..... F28D 11/02

[52] U.S. Cl. ..... 165/90; 492/46; 34/125; 34/124

[58] Field of Search ..... 165/90, 89; 492/46; 34/125, 124, 119

[56] References Cited

U.S. PATENT DOCUMENTS

| | | | |
|---|---|---|---|
| 1,953,525 | 4/1934 | Young | 165/90 X |
| 2,166,245 | 7/1939 | Goff et al. | 34/4 |
| 2,542,287 | 2/1951 | Neubauer | 34/124 |
| 2,712,924 | 7/1955 | Nicolai | 165/89 |
| 2,732,228 | 1/1956 | Armstrong | 285/110 |
| 2,911,234 | 11/1959 | Hieronymus | 285/53 |
| 2,993,282 | 7/1961 | Daane et al. | 34/125 |
| 3,265,411 | 8/1966 | Monroe et al. | 285/135 |
| 3,583,687 | 6/1971 | Nakahara | 165/90 X |
| 3,943,638 | 3/1976 | Robson | 34/124 |
| 4,235,002 | 11/1980 | Pav et al. | 165/89 X |
| 4,498,249 | 2/1985 | Cooke et al. | 34/125 |
| 4,501,075 | 2/1985 | Jenkner et al. | 34/125 |
| 4,590,688 | 5/1986 | Steffero, Sr. | 34/119 X |
| 4,691,452 | 9/1987 | Ferguson | 34/119 |
| 4,924,603 | 5/1990 | Wolf | 34/119 X |
| 5,180,002 | 1/1993 | Schwarz | 165/89 |

FOREIGN PATENT DOCUMENTS

| | | | |
|---|---|---|---|
| 2413271 | of 0000 | Germany . | |
| 8002187 | 10/1980 | WIPO | 34/125 |

*Primary Examiner*—John Rivell
*Assistant Examiner*—Christopher Atkinson
*Attorney, Agent, or Firm*—Beaman & Beaman

[57] ABSTRACT

A stationary syphon system for heat exchanger rolls, particularly suited for use with steam heated rolls wherein condensate must be removed from the roll chamber, utilizing a pivoted pick-up conduit mounted upon a journal conduit which is rigidly supported against radial deflection by a bearing interposed between the journal conduit inner end and the roll structure. The bearing may be mounted within a tube insertable into the journal bore to facilitate maintenance and replacement, and the condensate receiving end of the pick-up conduit is very accurately positioned with respect to the roll chamber inner surface by a positive locking arrangement remotely operated at the journal outer end.

15 Claims, 2 Drawing Sheets

STATIONARY SYPHON SYSTEM FOR ROTATING HEAT EXCHANGER ROLLS

BACKGROUND OF THE INVENTION

1. Field of the Invention

The invention pertains to stationary syphon systems for rotating heat exchanger rolls or drums utilizing a pivoted pick-up conduit wherein improved stability, efficiency, maintenance and installation characteristics are achieved.

2. Description of the Related Art

Rotating rolls and drums are commonly utilized to dry or heat moving webs during the manufacture of paper, cardboard, fabrics, and the like. In paper making and cardboard making mills, a plurality of rotating rolls or drums are used to sequentially engage the web to be heated or dried, and in modern mills, the tendency is for the rolls to operate at increasing rates of rotation to improve production.

Most heat exchanger rolls and drums utilized for drying are heated by steam injected into the roll through a rotary joint located at the end of one of the roll journals. The steam engages the inner surface of the roll or drum heating the roll periphery which is cooled by the transfer of heat to the web passing over the roll. The steam condensate, in a rapidly rotating roll, will be held against the roll inner chamber surface by centrifugal force and produces a thermal insulative barrier reducing the transfer of heat within the roll to the roll wall. Accordingly, it is highly desirable to remove the liquid condensate as quickly as possible to reduce the "rimming" condensate film thickness and improve the heat transfer characteristics between the steam and roll.

A variety of syphon systems are used with rotating rolls and drums for removing condensate. Basically, syphons fall into two categories. Rotary syphon systems utilize a pick-up shoe and conduit which is held against the roll or drum inner wall and rotates with the roll. The rotating syphon will withdraw condensate rimming 360° throughout the interior of the roll and is effective to maintain a minimum thickness of condensate in a rapidly rotating roll or drum. The second type of syphon system utilizes a stationary syphon wherein the syphon pick-up conduit does not rotate with the roller drum and has an entrance or pick-up shoe located near the lowermost portion of the roll inner chamber for removing condensate that collects by gravity at such lowermost location.

Rotating and stationary syphon systems each have their advantages and disadvantages. Rotating syphons can best be installed in large diameter rolls or drums having relatively large access openings located in the drum end plate or end head wherein access to the interior of the roller drum is possible to permit installation of the syphon. Rotating syphon systems can maintain a minimal thickness of condensate film within the rotating roll as there is no relative movement between the drum inner surface and syphon pick-up shoe. However, because there is no relative movement between the roll and pick-up shoe when the roll is not rotating, or rotating at slow speeds, introduction of steam into the roll causes the condensate to puddle at the lowermost regions of the roll and if the pick-up shoe is not located at the lowermost drum interior portion, the upper regions of the roll will heat to a much greater extent than the lower roll regions due to the lack of insulation produced by the condensate causing a slight warping or bending of the roll altering the tolerances and concentricity of the roll as it rotates during start up.

Stationary syphon systems are often used with smaller diameter roll and drum heat exchangers wherein access to the drum interior is restricted, and stationary syphons are usually used within the rolls or drums employed in the cardboard or corrugated board industry where the diameter of the drying rolls is less than the diameter of rolls and drums used in the paper making industry. In order to install a stationary syphon within a rotating roll or drum of a diameter of approximately two feet, or the like, the usual practice is to employ a syphon system which includes a horizontal pipe or conduit within the roll journal and a pick-up pipe or conduit usually attached to the inner end of the horizontal conduit by a pivot. When installing such a stationary two-part syphon, the pick-up conduit is pivoted to substantially axially align with the horizontal conduit for insertion of both conduits through the journal bore. Once the pick-up conduit is located within the roll interior chamber, it is permitted to pivot downwardly under gravity force so that the lower end of the pick-up conduit will be located adjacent the roll chamber inner surface, and the upper end of the pick-up conduit will be in communication with the horizontal conduit. This type of device is shown in U.S. Pat. No. 2,732,228.

Stationary syphons of the above type utilizing a pivoted pick-up conduit have several disadvantages. First, because the lowermost end of the pick-up conduit is only maintained in its operative position in close proximity to the roll inner surface by its own weight, it is difficult to accurately locate the lowermost end relative to the roll inner surface due to vibration and impact with the condensate. If the pick-up conduit lower end engages the roll inner surface, an objectionable scraping and wear occurs. If the lowermost end of the pick-up Conduit is excessively spaced from the roll interior surface, an objectionable radial thickness of condensate exists within the roll substantially reducing the thermal efficiency of the roll and will produce uneven heating during start up.

Further, as stationary syphon systems using pivoted pick-up conduits are normally supported at a location remote from the pick-up conduit, such as at the outer end of the journal, or within the rotary joint, this cantilever type support of the horizontal conduit and pick-up conduit permits radial instability due to lateral forces imposed upon the syphon by the moving condensate which will cause a movement and vibration of the syphon system alternately increasing and decreasing the spacing between the pick-up conduit lower end and the roll interior surface. Such vibrational movement of the syphon conduits causes stress and fractures requiring high maintenance costs. Rotating rolls and drums using stationary syphon systems are also subject to uneven roll heating problems during roll standstill or slow rotation if excessive spacing occurs between the lower end of the pick-up conduit and roll inner surface, and such excessive spacing and undesirable depth of condensate will permit the upper regions of the roll to excessively heat producing warping and bending of the roll which alters the tolerances of the rotating components, affects concentricity and will result in uneven heating and drying profiles in the material being heated, paper and corrugated material may be shredded, and uneven gluing of paper runs may occur.

OBJECTS OF THE INVENTION

It is an object of the invention to provide a stationary syphon system for rotating heat exchanger rolls wherein improved stability of the syphon system within the roll is achieved and reduced maintenance costs are experienced while minimal condensate depths may be maintained.

Another object of the invention is to provide a stationary syphon system for rotating heat exchanger rolls wherein improved stability of the syphon system is achieved by the utilization of a bearing interposed between the inner end of the syphon horizontal conduit located within the roll journal and the roll head adjacent the pick-up conduit portion of the syphon system.

Yet another object of the invention is to provide a stationary syphon system for rotating heat exchanger rolls which utilizes a supporting bearing within the innermost portion of the horizontal conduit and the bearing is located within a tube inserted within the journal bore to facilitate maintenance and replacement of the syphon system components.

An additional object of the invention is to provide a stationary syphon system for rotating heat exchanger rolls utilizing a pick-up conduit pivotally mounted to the horizontal conduit wherein a lock is used to hold the pick-up conduit in its operative position, and a stop is utilized to accurately position the lowermost end of the pick-up conduit with respect to the roll chamber inner surface.

A further object of the invention is to provide a stationary syphon system for rotating heat exchanger rolls utilizing a bearing located adjacent the roll head to provide improved stability to the syphon conduits and locking and stop structure are employed to locate and position a pivotally mounted pick-up conduit so that a high degree of stability is achieved and accurate positioning between the lower end of the pick-up conduit and the internal surface of the roll chamber can be maintained under all operating conditions.

SUMMARY OF THE INVENTION

A stationary syphon system for rotating heat exchanger rolls, particularly suitable in the manufacture of corrugated paper, consists of a horizontal conduit concentrically located within the roll journal bore and a pick-up conduit pivotally mounted at its upper end to the inner end of the horizontal conduit and having a lower end disposed adjacent the roll inner chamber surface when in the operating position. The pick-up conduit may be pivoted to an installation position relatively coaxial to the horizontal conduit as the syphon system is initially inserted into the roll through the journal bore.

The inner end of the horizontal conduit includes an enlarged cylindrical coupling portion circumscribed by an annular carbon bearing, and the carbon bearing is located within a tube positioned within the roll journal bore which is closely received within the roll journal bore at the roll head. Accordingly, the inner end of the syphon horizontal conduit is firmly supported against lateral deflection relative to the axis of roll rotation by the bearing and tube while relative rotation between the roll and syphon system conduits occurs.

Steam may be introduced into the tube outer end through the usual rotary joint, and in such instance, ports or orifices are defined in the tube communicating with channels or passages formed in the roll head, or coupling, permitting communication between the interior of the tube and the interior of the roll to permit steam to be introduced into the roll.

In order to accurately locate the lower end of the pick-up conduit to the internal surface of the roll, a positive stop surface is defined upon the pick-up conduit and the coupling at the inner end of the horizontal conduit to very accurately determine the angular relationship between the horizontal conduit and pick-up conduit, and this angular relationship as accurately determined by the engaging stop surfaces very accurately locates and determines the spacing between the pick-up conduit lower end and roll chamber surface so as to maintain the spacing at approximately two millimeters under all conditions during operation.

The pick-up conduit is maintained against its stop surfaces by a pair of locking bolts rotatably mounted within the horizontal conduit coupling parallel to the length thereof. These bolts extend through the length of the coupling and are threaded into holes formed in the upper end of the pick-up conduit at a location spaced from the pick-up conduit pivot. A head or shoulder located upon the bolts bears against the outer end of the coupling wherein upon threading the bolts into threaded holes within the pick-up coupling, the bolts may be tensioned to firmly maintain the stop surfaces on the coupling and pick-up conduit in engagement to positively lock the pick-up conduit with respect to the coupling and horizontal conduit preventing an increase in the pick-up conduit spacing entrance adjacent the roll inner surface.

The locking bolts are rotated by extensions attached to the bolts which extend through the tube having ends located adjacent the journal outer end. These extensions may be of a hexagonal configuration fitting into hex sockets within the bolt heads and when the rotary joint or syphon fittings normally attached to the end of the journal are removed, the syphon locking bolts can be tightened or unloosened at the open end of the journal by conventional wrenches. Preferably, a pair of extension supports are mounted upon the horizontal syphon conduit to support the extensions in a rotative parallel relationship thereto.

The use of the bearing at the innermost portion of the syphon horizontal conduit provides the stationary syphon system with a high degree of radial stability. The location of the bearing within the tube permits the bearing and associated syphon structure to be readily removed or installed within the roll journal, and the use of the locking bolts and stop surfaces to firmly locate the pivoted pick-up conduit relative to the horizontal conduit permits the lowermost end of the pick-up conduit to be very accurately positioned relative to the roll inner surface under all conditions of operation, and prevents the formation of a significant puddle of condensate during roll standstill or slow rotation. The improved stability of the stationary syphon system of the invention, and the ability of the pick-up conduit to be closely and accurately maintained with respect to the roll inner surface substantially eliminates uneven heating of the rolls during standstill and start up.

The construction of a stationary syphon system in accord with the invention permits the syphon system to be retrofitted to many existing roll or drum constructions, and significant advantages with respect to stationary syphon systems are achieved by the practice of the invention.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
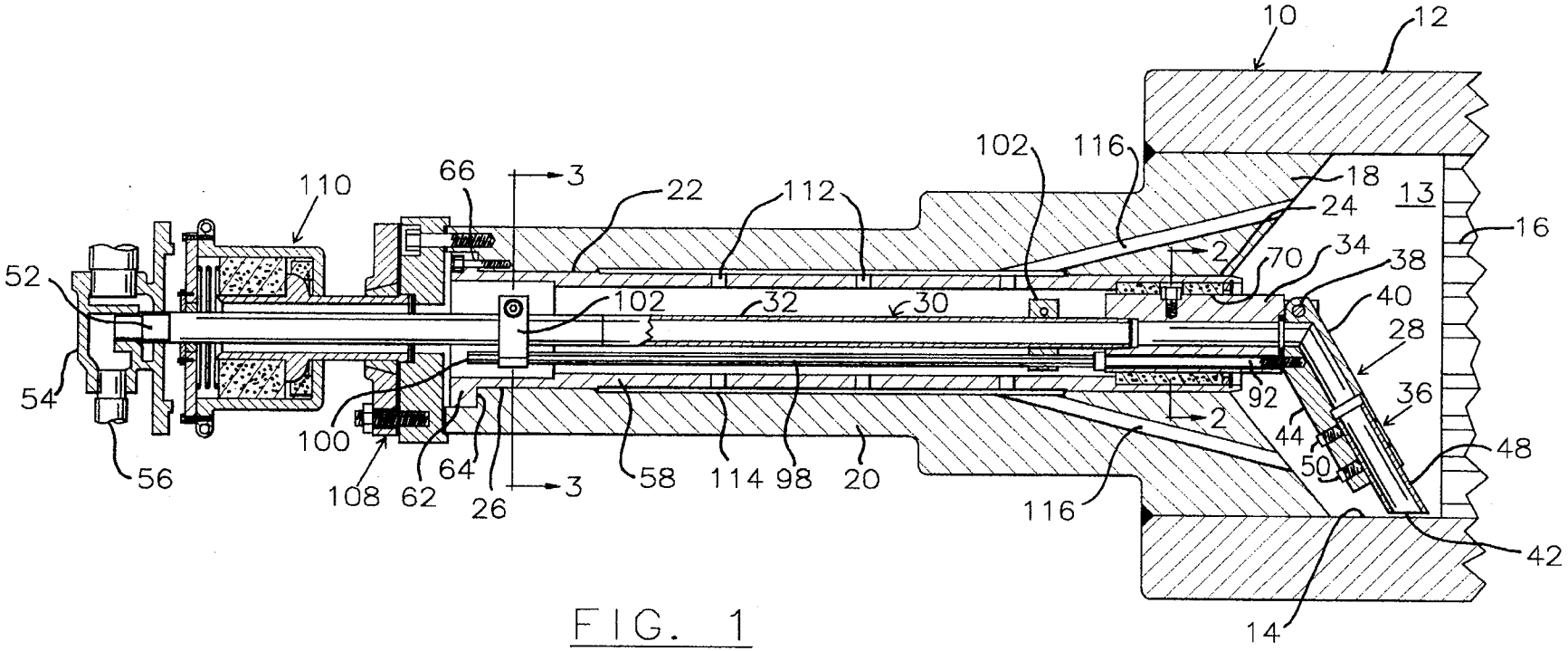
FIG. 1 is a diametrical sectional view of a stationary syphon system in accord with the invention illustrating the pick-up conduit in the operative position.

The general overall assembly utilizing the concepts of the invention is shown in FIG. 1 wherein the heat exchanger roll or drum 10 is illustrated as having an outer cylindrical surface 12 which engages the paper or web which is to be heated or dried, and the roll is hollow to define a chamber 13 having a cylindrical inner surface 14. A plurality of longitudinally extending grooves 16 may be defined within the inner surface 14 to facilitate the flow of condensate to the inner surface 14, which may be of a slightly enlarged diameter to define a sump in which the condensate collects, as is known in the art.

The end of the roll 10 is closed by a head 18 which is welded into the end of the roll, and in the disclosed construction, the head 18 is integral with the roll journal 20 supported upon the roll bearings, not shown. The journal 20 defines the axis of roll rotation, and in some constructions, the head 18 will constitute a separate assembly from the journal 20.

The Journal 20 includes a longitudinally extending concentric bore 22 which communicates at its inner end 24 with the chamber 13, and the bore outer end 26 intersects the journal outer end.

In FIG. 1, the stationary syphon system of the invention is generally indicated at 28 and includes a horizontal journal conduit 30 located within the journal bore 22 which consists of a pipe 32 welded into a cylindrical tubular coupling 34 in radial alignment with the journal inner end 24.

The syphon system 28 also includes the pick-up conduit 36 which is pivotally mounted to the horizontal conduit 30 at the coupling 34. The pick-up conduit includes an upper end 40 connected to the coupling 34 by pivot 38, and a lower end 42 which is formed at an angle to be parallel to the roll inner surface 14 as apparent. In the disclosed embodiment, the pick-up conduit 36 is formed of several components, including an adapter 44 having a passage 46 defined therein. A pipe 48 is received within the adapter passage 46 and is maintained therein by the set screws 50 threaded into holes defined in the adapter. Tightening of the set screws 50 maintains the pipe 48 firmly within the adapter 44, and permits the pipe 48 to be adjusted or replaced. As will be appreciated, it is the lower end of the pipe 48 which defines the lower end 42 of the pick-up conduit assembly 36.

The outer end of the pipe 32 of the horizontal conduit 30 extends through the journal bore 22 and is in fixed communication with a syphon discharge fitting 52 connected to a condensate drain pipe 56 as well known in the art.

A cylindrical tube 58 is located within the journal bore 22, and is of a length substantially equal to the journal bore as will be appreciated from FIG. 1. The tube inner end 60 is cylindrical and is closely received within the bore inner end 24, and the tube outer end 62 includes a shoulder 64 cooperating with a radial shoulder defined on the end of the journal 22 and held in engagement therewith by the bolt 66. The bolt 66 and shoulder 64 affix the tube 58 against axial displacement relative to the journal bore 22.

An annular recess 68 is defined within the tube 58 adjacent its inner end 60, and the recess 68 rotatably receives an annular carbon bearing 70 whose inner diameter engages and circumscribes the coupling 34. A retainer 72 located within a groove in the tube 58 maintains a spacer 72 within the tube located against the bearing 70. A bolt 76 is radially threaded into the coupling 34 having a head received within the radial opening 78 defined in the bearing 70 preventing relative rotation between the bearing 70 and the coupling 34. Accordingly, the relative rotation between the bearing 70 and the tube 58 occurs at the surface of the recess 68. However, if it is desired that relative rotation occur between the bearing 70 and the coupling 34, the bolt 76 will not be used.

A countersunk recess 80 concentric to the bore within the coupling 34 receives the resilient O-ring 82, and the O-ring 82 engages the flat surface 84 defined upon the adapter 44. The coupling 34 is formed with a flat end surface 86, and when the pick-up coupling 36 is in its operative position as shown in FIG. 1, the surfaces 84 and 86 will be engaging in metal-to-metal contact forming a positive stop against further clockwise pivoting of the pick-up conduit 36 about the pivot 38.

A pair of longitudinal extending bolt holes 88 are defined in the coupling 34 parallel to the coupling axis and a pair of threaded holes 90 are defined in the adapter 44 which align with the coupling holes 88 when the pick-up conduit 36 is in its operative position. A pair of bolts 92 are rotatably received within the coupling holes 88 and will thread into the adapter holes 90 in the operative position of the pick-up conduit.

The bolts 92 are each provided with an enlarged head 94 which will bear against the coupling surface 96, and when the bolts are tightened within the adapter holes 90 they draw the surfaces 84 and 86 into engagement.

Rotation of the bolts 92 is accomplished through an extension 98 attached to each bolt head 94. The bolt heads 94 may be of the Allen screw type having hexagonal recesses,and the extensions 98 may constitute hexagonal bars received within the heads 94 and welded therein. The outer ends 100 of the extensions 98 are located adjacent the tube outer end 62, FIG. 1, and the bolts 92 may be tightened or unloosened by applying a wrench socket to the extension ends 100 to rotate the extensions and the associated bolts 92.

Figure 3:
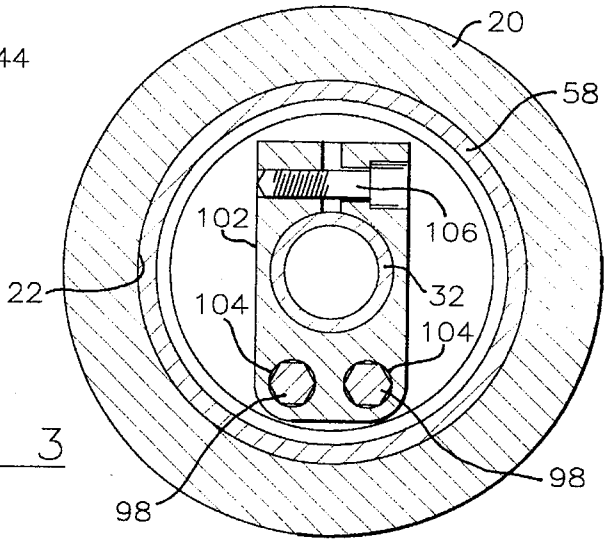
FIG. 3 is an enlarged detail sectional view taken through a bolt extension support along Section 3—3 of FIG. 1.

A pair of split ring type supports 102 are mounted upon the horizontal conduit pipe 32, FIGS. 1 and 3, and the supports 102 include holes 104 rotatably supporting the extensions 98. The supports 102 may be tightened upon the pipe 32 by the bolt 106.

If steam is to be inserted into the roll 10 through the journal 20, a mounting flange 108 is mounted upon the outer end of the journal 20 and supports the rotary joint 110 which is connected to a conventional steam supply, not shown. The mounting flange 108 is similar to that shown in the assignee's U.S. Pat. No. 2,911,234, and the construction of the rotary joint 110 may be of any conventional construction and forms no part of the instant invention. As will be appreciated, the horizontal conduit syphon pipe 32 extends through the rotary joint 110, as is conventional.

If steam is to be introduced into the journal 20 and tube 58, the tube 58 is provided with a plurality of radial ports 112 which communicate with an annular recess 114 defined within the journal bore 22 in radial alignment with the ports. Several passages 116 are formed within the journal 20 and head 18 in communication with the recess 114 and the roll chamber 13 permitting the steam to be introduced into the roll 10.

Installation of a stationary syphon system in accord with the invention will now be described:

To install the syphon system 28 into the roll 10, the rotary joint mounting adapter and flange 108 will be removed from the journal outer end leaving the journal bore 22 open. The syphon system 28 will have been assembled within the tube 58 as shown in FIG. 1, but when installing the syphon system the bolts 92 will not be threaded into the adapter holes 90 and the pick-up conduit 36 may be lifted so that its longitudinal axis is substantially parallel to the axis of the horizontal conduit 30. Thereupon, the tube 58 is inserted into the journal bore 22.

Upon the tube 58 and associated syphon conduits being fully inserted into the bore 22, the tube inner end 60 will be closely received within the bore inner end 24. The tube shoulder 64 will engage the journal shoulder, and the bolt 66 may be inserted and tightened to axially position the tube 58 within bore 22. When the tube 58 is fully inserted, the pick-up conduit 36 will pivot under gravitational forces to the operative position shown in FIG. 1.

A wrench may now be applied to each of the bolt extensions 98 to rotate the bolts 92 which will thread into the adapter holes 90, and draw the adapter surface 84 into an engaging relationship with the coupling end surface 86. Proper tightening of the bolts 92 to firmly engage surfaces 84 and 86 will position the pick-up conduit oblique lower end 42 as close as two millimeters inwardly of the roll inner surface 14, and this important close dimensional relationship can be accurately determined by previously longitudinally positioning the pipe 48 within the adapter 44 by means of the set screws 50. The engagement of the adapter surface 84 with the O-ring 82 will establish a sealed relationship between the pick-up conduit 36 and the horizontal conduit 30.

After the syphon system 28 is properly installed within the roll 10, the mounting flange 108 and rotary joint 110 may be mounted upon the end of the journal 20, and the syphon discharge fitting 54 attached to the outer end of the pipe 32.

As the pick-up conduit lower end 42 is now properly located close to, but not engaging, the roll inner surface 14, the introduction of steam into the chamber 13 and the accumulation of condensate will not affect the circumferential temperature of the roll as the condensate will be quickly removed from the roll even if the roll is not rotating, or is slowly rotating. The angular orientation of the pick-up conduit 36 so that it will always be located at the proper lowermost portion of the roll inner surface 14 is assured by the fixed connection of the pipe 32 to the fitting 54, and no lateral deflection of the pick-up conduit 36 or the horizontal conduit 30 will occur because of the firm support of the inner end of the horizontal conduit 30 achieved by the presence of the bearing 70. As the coupling 34 and bearing 70 are in radial alignment with the roll head 18, no "bending" of the inner end of the journal conduit 30 is possible. The use of the locking bolts 92 and stop surfaces 84 and 86 assures that the pick-up conduit lower end 42 will always be properly related to the roll inner surface 14 and sealing between the horizontal and pick-up conduits is continuous as no lifting or bouncing of the pick-up conduit can occur as is possible with pivoted pick-up conduits of conventional construction wherein no locking means is utilized.

In some heat exchanger rolls, steam is introduced at one end of the roll, and the condensate is removed at the other. In such an instance, the rotary joint 110 is not utilized and other known sealing structure will be employed to seal the end of the journal 22 during operation, and of course, in such an arrangement, the tube ports 112 need not exist as the roll head associated with the syphon system would not have the steam passages 116 defined therein.

Figure 2:
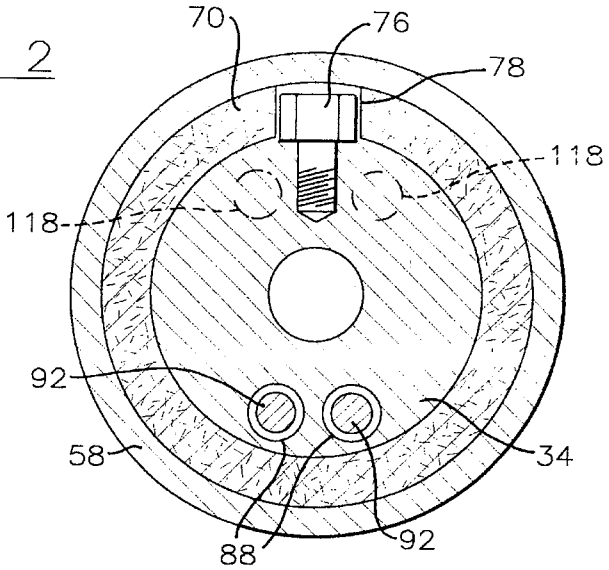
FIG. 2 is an elevational detail sectional view taken through the horizontal conduit and tube inner end along Section 2—2 of FIG. 1.
Figure 4:
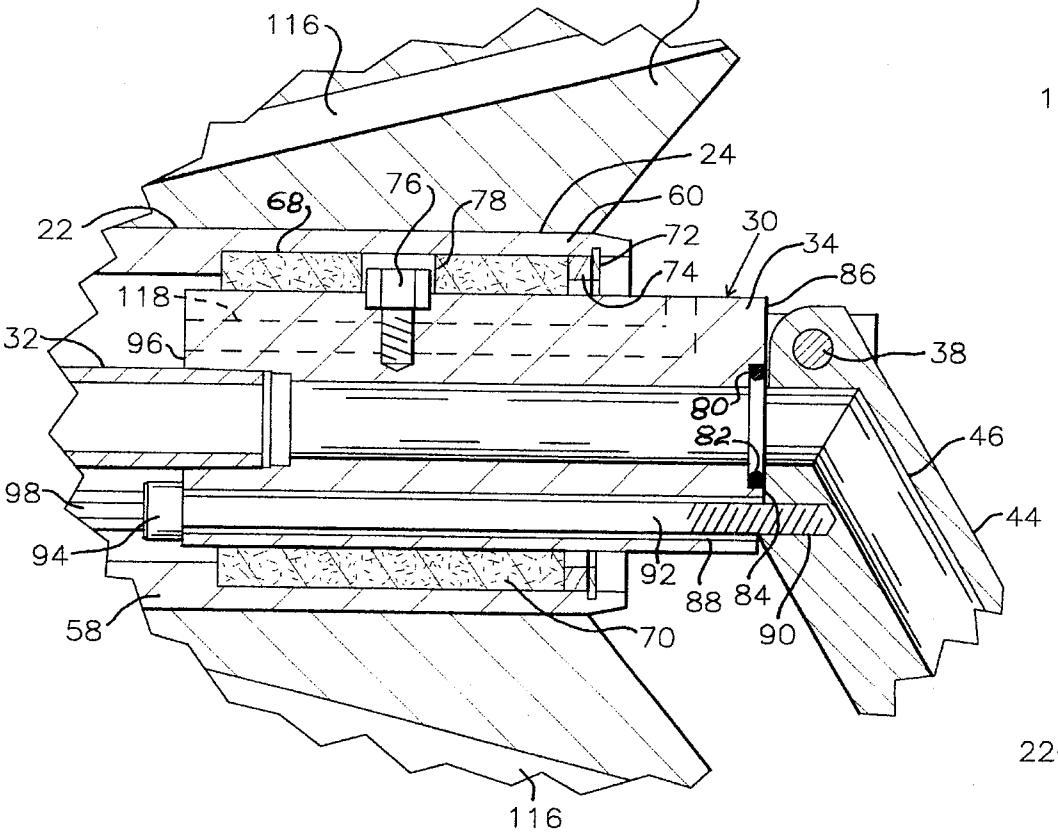
FIG. 4 is an enlarged detail elevational sectional view of the inner end of the stationary syphon system in accord with the invention.

The syphon system of the invention can be retrofitted to existing rolls having a journal diameter large enough to receive the tube 58. In such a retrofitting installation, the roll head would probably not include passages similar to those indicated at 116 in FIG. 1. However, steam passages can be formed in the coupling 34 as shown at dotted lines at 118 in FIGS. 2 and 4 whereby steam introduced into the tube 58 will pass into the interior of the roll without requiring any special steam passages defined in the head or slots or holes could be formed in the inner end 60 of tube 58 to permit the steam to pass into the roll chamber 13.

It is appreciated that various modifications to the inventive concepts may be apparent to those skilled in the art without departing from the spirit and scope of the invention.

We claim:

1. In a stationary syphon system for rotating heat exchanger rolls having an axis of rotation, an end, an interior chamber, an inner surface, a head sealing the roll end and a tubular journal concentric to the axis of rotation attached to the head having a bore having an inner end in communication with the roll interior chamber and an outer end, the syphon system including a journal conduit concentrically located within the journal bore having an inner end extending into the roll interior chamber and an outer end extending from the journal bore outer end, a pick-up conduit having an upper end in communication with the journal conduit inner end and a lower end located adjacent the lowermost portion of the roll interior chamber inner surface, a disposal fitting in communication with the journal conduit outer end for removing liquid from the journal conduit, and removable sealing structure mounted on the journal sealing the journal bore outer end, the journal conduit outer end sealingly extending through the removable sealing structure, the improvement comprising, a removable cylindrical tube within the journal bore having an inner end closely received within the journal bore adjacent the roll head, the journal conduit extending through said tube, an annular bearing interposed between the journal conduit inner end and said tube inner end to prevent radial displacement of the journal conduit inner end with respect to the roll axis of rotation, and a fastener interposed between said tube and the journal to prevent axial displacement therebetween.

2. In a stationary syphon system for rotating heat exchanger rolls as in claim 1, said tube inner end, the journal conduit inner end and said bearing being in radial alignment with the roll head.

3. In a stationary syphon system for rotating heat exchanger rolls as in claim 2, said bearing comprising an annular sleeve bearing.

4. In a stationary syphon system for rotating heat exchanger rolls as in claim 3, said bearing comprising a carbon sleeve bearing.

5. In a stationary syphon system for rotating heat exchanger rolls as in claim 4, the journal conduit inner end comprising an enlarged cylindrical coupling, said bearing circumscribing said coupling.

6. In a stationary syphon system for rotating heat exchanger rolls as in claim 1, the removable sealing structure mounted on the journal sealing the journal bore outer end including a rotary joint for introducing steam into the journal bore and said tube, and passage means establishing communication between the interior of said tube and the roll interior chamber.

7. In a stationary syphon system for rotating heat exchanger rolls as in claim 6, said passage means including ports defined in said tube adjacent the roll head, and channels defined in the roll head in communication with the roll interior chamber and said tube ports.

8. In a stationary syphon system for rotating heat exchanger rolls as in claim 6, the journal conduit inner end comprising an enlarged cylindrical coupling, said bearing circumscribing said coupling, said passage means comprising a bore defined in said coupling communicating with said tube and the roll interior chamber.

9. In a stationary syphon system for rotating heat exchanger rolls having an axis of rotation, an end, an interior chamber, an inner surface, a head sealing the roll end and a tubular journal concentric to the axis of rotation attached to the head having a bore having an inner end in communication with the roll interior chamber and an outer end, the syphon system including a journal conduit concentrically located within the journal bore having an inner end extending into the roll interior chamber and an outer end extending from the journal bore outer end, a pick-up conduit having an upper end in communication with the journal conduit inner end and a lower end located adjacent the lowermost portion of the roll interior chamber inner surface, a disposal fitting in communication with the journal conduit outer end for removing liquid from the journal conduit, and removable sealing structure mounted on the journal sealing the journal bore outer end, the journal conduit outer end sealingly extending through the removable sealing structure, the improvement comprising, a pivot pivotally mounting the pick-up conduit upper end upon said journal conduit inner end permitting pivoting of the pick-up conduit between an installation position and syphoning operative position, and locking means mounted on the journal conduit inner end operable from the journal outer end for locking the pick-up conduit in said operative position.

10. In a stationary syphon system for rotating heat exchanger rolls as in claim 9, said locking means comprising a threaded bolt threadably engaging the pick-up conduit upper end at a location spaced from said pivot.

11. In a stationary syphon system for rotating heat exchanger rolls as in claim 10, said threaded bolt being located adjacent the journal conduit inner end, and a bolt extension extending through the journal bore attached to said bolt and having a torque transmitting end adjacent the journal bore outer end.

12. In a stationary syphon system for rotating heat exchanger rolls as in claim 9, a bearing interposed between the journal conduit inner end and the roll adjacent the roll head to prevent radial displacement of the journal conduit inner end with respect to the roll axis of rotation, the journal conduit inner end comprising an enlarged cylindrical coupling, said bearing circumscribing said coupling, said locking means being mounted on said coupling, a positive stop defined on said coupling engaging the pick-up conduit when in said operative position to accurately locate the pick-up conduit lower end with respect to the roll chamber inner surface.

13. In a stationary syphon system for rotating heat exchanger rolls as in claim 12, said locking means comprising a threaded bolt rotatably mounted upon said coupling threadedly engaging the pick-up conduit when in the operative position at a location spaced from said pivot.

14. In a stationary syphon system for rotating heat exchanger rolls as in claim 13, a bolt extension connected to said bolt and extending through the journal bore having a torque transmitting end adjacent the journal bore outer end.

15. In a stationary syphon system for rotating heat exchanger rolls as in claim 14, extension support means mounted on the journal conduit between said coupling and the journal bore outer end.

* * * * *